US007114334B2

(12) United States Patent
Pellizzari

(10) Patent No.: US 7,114,334 B2
(45) Date of Patent: Oct. 3, 2006

(54) IMPINGEMENT HEAT EXCHANGER FOR STIRLING CYCLE MACHINES

(75) Inventor: Robert Pellizzari, Groton, MA (US)

(73) Assignee: TIAX LLC, Cambridge, MA (US)

( * ) Notice: Subject to any disclaimer, the term of this patent is extended or adjusted under 35 U.S.C. 154(b) by 0 days.

(21) Appl. No.: 10/883,310

(22) Filed: Jul. 1, 2004

(65) Prior Publication Data

US 2005/0016170 A1 Jan. 27, 2005

Related U.S. Application Data

(60) Provisional application No. 60/484,589, filed on Jul. 1, 2003.

(51) Int. Cl.
*F01B 29/10* (2006.01)

(52) U.S. Cl. ..... 60/524; 60/526

(58) Field of Classification Search ..... 60/517, 60/524, 526

See application file for complete search history.

(56) References Cited

U.S. PATENT DOCUMENTS

| | | | | |
|---|---|---|---|---|
| 2,616,250 A | | 11/1952 | Yzer | 60/24 |
| 3,579,980 A | | 5/1971 | Kelly | 60/24 |
| 3,717,993 A | | 2/1973 | Potter | 60/24 |
| 3,830,063 A | * | 8/1974 | Morgan | 60/645 |
| 4,050,250 A | | 9/1977 | Danis | 60/517 |
| 4,074,533 A | | 2/1978 | Stockton | 60/620 |
| 4,230,651 A | | 10/1980 | Rao | 264/29 |
| 4,330,993 A | | 5/1982 | Beale | 60/520 |
| 4,662,176 A | | 5/1987 | Fujiwara et al. | 60/526 |
| 4,821,516 A | | 4/1989 | Isshiki | 60/517 |
| 4,984,428 A | | 1/1991 | Momose et al. | 60/517 |
| 5,016,707 A | * | 5/1991 | Nguyen | 165/167 |
| 5,129,449 A | * | 7/1992 | Nguyen | 165/110 |
| 5,239,833 A | | 8/1993 | Fineblum | 62/6 |
| 5,533,566 A | | 7/1996 | Fineblum | 165/1 |
| 5,611,214 A | | 3/1997 | Wegeng et al. | 62/498 |
| 5,735,123 A | | 4/1998 | Ehrig | 60/525 |
| 5,811,062 A | | 9/1998 | Wegeng et al. | 422/129 |
| 6,381,958 B1 | * | 5/2002 | Kamen et al. | 60/517 |
| 6,694,731 B1 | * | 2/2004 | Kamen et al. | 60/524 |
| 6,715,285 B1 | * | 4/2004 | Isaac, Jr. | 60/520 |
| 2001/0032452 A1 | | 10/2001 | Kamen et al. | 60/39.6 |

FOREIGN PATENT DOCUMENTS

| | | |
|---|---|---|
| GB | 2 194 596 | 3/1988 |
| SU | 1096389 | 6/1984 |
| SU | 1116202 | 9/1984 |

* cited by examiner

OTHER PUBLICATIONS

Journal of Electronics Manufacturing, vol. 9, No. 2 (Jun. 1999) 167-178 Enhanced Jet Impingement Heat Transfer With Crossflow At Low Reynolds Numbers-G. Failla et al.

*Primary Examiner*—Hoang Nguyen
(74) *Attorney, Agent, or Firm*—Lowrie, Lando & Anastasi, LLP

(57) ABSTRACT

Impingement style heat exchanger through which significant heat transfer improvements can be obtained. The heat exchanger of the present invention operates such that the bulk of heat transfer between the heat source and the working fluid occurs during the portion of the Stirling cycle in which the working fluid impinges upon the pressure vessel surface. Either or both of two heat exchanger configurations may be used. In a first, the impingement heat transfer occurs while the fluid is traveling in the forward direction and towards the expansion space in the vessel. In contrast, and in connection with the second configuration of the heat exchanger of the present invention, the impingement heat transfer occurs while the working fluid is traveling in the backward direction and toward the compression space of the vessel.

26 Claims, 4 Drawing Sheets

Backward Direction
365
340
310
370
390
360
350
325
315
335
Forward Direction

IMPINGEMENT HEAT EXCHANGER FOR STIRLING CYCLE MACHINES

RELATED APPLICATIONS

This patent application claims priority from Provisional Application Ser. No. 60/484,589, filed on Jul. 1, 2003, the contents of which are hereby incorporated by reference.

FIELD

The present invention relates to Stirling cycle machines and more particularly to heat exchangers in Stirling cycle machines which are used to transfer heat to and from the working fluid during operation.

BACKGROUND

The Stirling cycle engine was originally conceived during the early portion of the nineteenth century by Robert Stirling. During the middle of the nineteenth century, commercial applications of this hot gas engine were devised to provide rotary power to mills. The Stirling engine was ignored thereafter until the middle of the twentieth century because of the success and popularity of the internal combustion engine. Stirling cycle machines, including engines and refrigerators, are described in detail in Walker, Stirling Engines, Oxford University Press (1980), incorporated herein by reference.

The principle underlying the Stirling cycle engine is the mechanical realization of the Stirling thermodynamic cycle: 1) isovolumetric heating of a gas within a cylinder, 2) isothermal expansion of the gas (during which work is performed by driving a piston), 3) isovolumetric cooling and 4) isothermal compression. Additional background regarding aspects of Stirling cycle machines and improvements thereto are discussed in Hargreaves, The Phillips Stirling Engine (Elsevier, Amsterdam, 1991), incorporated herein by reference.

The high theoretical efficiency of the Stirling engine has attracted considerable interest in recent years. The Stirling engine adds the additional advantages of easy control of combustion emissions, potential use of safer, cheaper, and more readily available fuels and quiet running operation, all of which combine to make the Stirling engine a highly desirable alternative to the internal combustion engine for many applications.

Despite these advantages, development of the Stirling engine has proceeded at a much slower rate than might otherwise be expected. Some of the more acute problems include the need to seal the working gas at a high pressure within the working space, the requirement for transferring heat at high temperature from the heat source to the working gas through the heater head, and a simple, reliable and inexpensive means for modulating the power as the load changes.

One design, which is well suited to a variety of applications, is the free-piston Stirling engine. The free-piston Stirling engine uses a displacer that is mechanically independent of the power output member. Its motion and phasing relative to the power output member is accomplished by the state of a balanced dynamic system of springs and masses, rather than a mechanical linkage.

Stirling engines have been proposed for use in a wide range of applications. Examples include automotive applications, refrigeration systems and applications in outer space. The need to power portable electronics equipment, communications gear, medical devices and other equipment in remote field service presents yet another opportunity, as these applications require power sources that provide both high power and energy density, while also requiring minimal size and weight, low emissions and cost.

To date, batteries have been the principal means for supplying portable sources of power. However, the time required for recharging batteries has proven inconvenient for continuous use applications. Moreover, portable batteries are generally limited to power production in the range of several milliwatts to a few watts and thus cannot address the need for significant levels of mobile, lightweight power production.

Small generators powered by internal combustion engines, whether gasoline- or diesel-fueled have also been used. However, the noise and emission characteristics of such generators have made them wholly unsuitable for a wide range of mobile power systems and unsafe for indoor use. While conventional heat engines powered by high energy density liquid fuels offer advantages with respect to size, thermodynamic scaling and cost considerations have tended to favor their use in larger power plants.

In order to execute the Stirling cycle, either for the purpose of making power as in an engine embodiment or for the purpose of refrigeration as in a cooler embodiment, the machine must be provided with both an external heat source and an external heat sink. Heat transfer between the external pressure vessel wall of the machine and the working fluid is typically accomplished through the use of internal heat exchangers. Maximum efficiency is obtained when as much heat as possible is transferred to the working fluid rather than to engine components or other heat absorbers.

Heat transfer to the working fluid is affected by three heat exchanger characteristics: 1) the surface area of the heat exchanger that is in contact with the heat source/sink and the working fluid, 2) the heat transfer coefficient between the working fluid and the surface, and 3) the temperature differential between the heat exchanger surface and the working fluid. Improved heat transfer can be effected by increasing any or all of these three parameters.

The desire for high thermal efficiencies in Stirling engines dictates high regenerator effectiveness and as a result, the fluid exiting the regenerator and entering the hot end heat exchanger, henceforth referred to as the "heater", is at or near the temperature of the heater walls. Similarly, the temperature of the working fluid exiting the regenerator and entering the cold end heat exchanger, henceforth referred to as the "cooler", is at or near the temperature of the cooler walls. Further, since engine pressure variations are typically low, particularly in free-piston Stirling machine embodiments, end state expanded or compressed fluid temperatures tend towards the heater and cooler wall temperatures, respectively. Additionally, working fluid temperatures within conventional heater or cooler heat exchangers vary spatially with the maximum temperature differential between the working fluid and the heat exchanger walls at the respective heat exchanger inlets, and decreasing along the lengths of the heat exchangers until reaching a minimum at the heat exchanger exit where, if the heat exchangers are reasonably well designed, the working fluid has reached very nearly the heat exchanger wall temperature. As a result, the effective temperature differentials between the heater and cooler heat exchangers and working fluid in well designed Stirling cycle machines are, by design small.

Conventional heat exchanger designs for Stirling cycle machines typically employ slots or holes inside of thick walls, tubes, or alternatively, extended surfaces within channels such as fins of various types. Traditional heat exchanger designs which are used within Stirling cycle machines operate with a low temperature differential between the heat source and the working fluid as discussed above. In order to compensate for the low temperature differentials between the heat source or sink and the working fluid, traditional heat exchanger applications in connection with Stirling cycle machines have suffered from other tradeoffs.

For example, in some cases heat exchanger structures must be larger than desirable in order to provide the necessary increased surface area for effective heat transfer. This, in turn results in larger engine sizes, less space for other engine components, or both. Additionally, in some cases solutions designed to achieve the necessary heat transfer have required the use of expensive, and sometimes exotic, materials as well as expensive, time-consuming and sometimes less than reliable manufacturing processes and designs.

Other drawbacks also exist with prior art heat exchanger designs. For example, the requirement for metal-to-metal contact between the pressure vessel and the heat exchanger walls to achieve minimal thermal resistance results in designs that are difficult to fabricate and thus expensive.

In lieu of providing a large surface area to achieve the required heat transfer, the heat exchanger may be designed to generate high heat transfer coefficients, albeit at the expense of somewhat higher pressure drops in the heat exchanger. However, significant manufacturing, assembly and cost benefits accrue from eliminating the need for extended surface heat exchangers.

SUMMARY

One aspect is to provide a heat exchanger for use with Stirling cycle machines which provides the required heat transfer capability.

Another aspect is to provide a such a heat exchanger which is cost efficient and functionally reliable.

Yet another aspect is to provide such a heat exchanger which is easily manufactured and installed.

A still further aspect is to provide a heat exchanger which is inexpensively manufactured and installed.

A still further aspect is to provide a heat exchanger that offers the ability to locally vary heat transfer in order to match the spatial heat transfer characteristics of the external heat exchangers to maximize heat transfer and control temperature gradients.

A still further aspect is to provide a heat exchanger that offers the ability to transfer heat to and from the working fluid at significantly different rates depending upon the direction of flow so as to enhance and/or modify the thermodynamic cycle for improved efficiency and/or output.

A preferred form of the present invention comprises an impingement style heat exchanger, the use of which can provide significant heat transfer improvements and cost reductions. The heat exchanger of the present invention operates such that the bulk of heat transfer between the heat source and the working fluid occurs during the portion of the Stirling cycle in which the working fluid impinges upon the pressure vessel surface. The impingement heat exchanger may be configured so that the impingement of the working fluid upon the vessel surface occurs in either flow direction. For the heater, the impingement heat exchanger may be configured so that the bulk of the heat transferred to the fluid during the cycle occurs either as the fluid enters or exits the expansion space. Similarly for the cooler, the impingement heat exchangers may be configured so that the bulk of the heat transferred from the fluid during the cycle occurs either as the fluid enters or exits the compression space.

According to the teachings of the present invention, two different impingement heat exchanger configurations are possible. In a first, referred to herein as the forward flow impingement heat exchanger ("FFIHX") configuration for both heater and cooler applications, the impingement heat transfer occurs while the fluid is traveling in the forward direction and towards the expansion space in the vessel. In contrast, and in connection with the second configuration of the heat exchanger of the present invention, referred to herein as the backward flow impingement heat exchanger ("BFIHX") configuration for both heater and cooler applications, the impingement heat transfer occurs while the working fluid is traveling in the backward direction and toward the compression space of the vessel.

The FFIHX configuration of the heat exchanger of the present invention may be used in connection with either the cooler or the heater. In one heater embodiment, the FFIHX is positioned adjacent to the expansion space of the vessel with a manifold between the heat exchanger and the vessel wall. In this way, working fluid from the regenerator may be heated as it enters the forward flow heat exchanger and passes through the impingement ports so as to impinge upon the heated surface of the vessel wall. When the working fluid is forced from the expansion space toward the compression space (through the regenerator) and cooling is desired, the working fluid passes through the forward flow heat exchanger and impinges on the cooler interior surface of the heat exchanger. With the FFIHX heater configuration, the bulk of the cycle heat transferred to the working fluid is accomplished when the flow is towards the expansion space. The fraction of the total heat that is transferred from the pressure vessel wall to the working fluid in the FFIHX heater during the forward flowing portion of the cycle, as opposed to the backward flowing portion of the cycle, may be tailored through the particular design of the FFIHX.

The BFIHX configuration of the heat exchanger of the present invention may be used in connection with either the cooler or the heater. In the case of the former, the BFIHX is positioned below the regenerator adjacent to the compression space. As the working fluid, in a relatively heated state, is forced from the compression space toward the expansion space of the engine, it passes through the BFIHX and the fluid impinges on the relatively hotter surface of the heat exchanger which is adjacent to the compression space. When fluid flows in the other direction from the expansion space to the compression space and cooling is desired, the fluid impinges on the pressure vessel wall which is the relatively cooler surface of the cooler mechanism. With the BFIHX cooler configuration the bulk of the cycle heat extracted from the working fluid is accomplished when the flow is towards the compression space. The fraction of the total heat that is transferred from the working fluid to the pressure vessel wall in the BFIHX cooler during the backward flowing portion of the cycle, as opposed to the forward flowing portion of the cycle, may be tailored through the particular design of the BFIHX.

The BFIHX configuration may also be used in a heating capacity. In this case, this form of the heat exchanger of the present invention is located in the upper portion of the pressure vessel adjacent to the expansion space. When working fluid is flowing from the compression space towards the expansion space and after it has passed through the regenerator, the fluid obtains heat transfer by virtue of the fact that it is flowing between the relatively hotter surface of the pressure vessel wall and the impingement baffle prior to entering the expansion space via the impingement ports. When working fluid is forced from the expansion space towards the compression space the fluid impinges on the pressure vessel wall and the fluid is heated. As the fluid continues to flow toward the compression space it passes through the regenerator where it gives up much of this heat which it can recapture when flow reverses.

Other embodiments of the present invention are also possible as described in further detail below and as will be understood by one of skill in the art.

BRIEF DESCRIPTION OF THE DRAWINGS

The invention will now be described in more detail with reference to preferred forms of the invention, given only by way of example, and with reference to the accompanying drawings, in which.

DETAILED DESCRIPTION

Reference is now made to the embodiments illustrated in FIGS. 1–4 wherein like numerals are used to designate like parts throughout. It will be understood by one of skill in the art that, although the invention is described below in the context of a free piston Stirling engine, its application is not necessarily limited thereto and the invention is defined only by the appended claims. It will further be understood that various other applications of the invention, including, for example, and not by way of limitation, applications in connection with various heat engines and cooler machines whether or not such engines or machines operate based upon the Stirling cycle.

Figure 1:
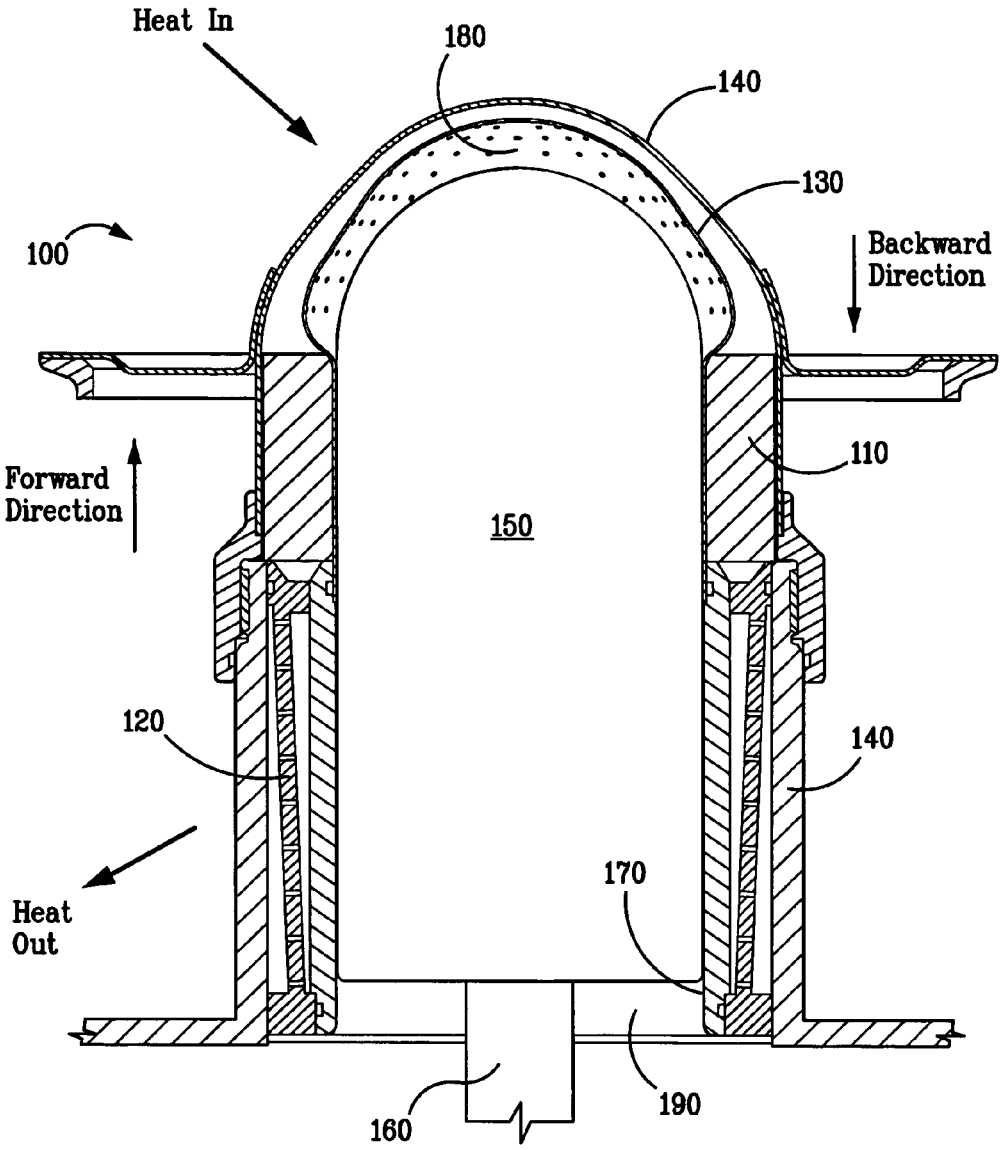
FIG. 1 is a sectional view of a portion of a Stirling engine according to the present invention showing BFIHX heater and BFIHX cooler embodiments.

FIG. 1 is a sectional view of a portion of a free piston Stirling engine (FPSE) 100 designed according to the teachings of the present invention. FPSE 100 includes cylinder 170 within which displacer piston 150 reciprocates axially. The displacer piston 150 defines an expansion chamber 180 of variable volume between displacer piston 150 and cylinder head 140. The volume of expansion chamber 180 changes during engine operation as displacer piston 150 reciprocates toward and away from cylinder head 140. Displacer piston 150 rides on a displacer piston rod 160. Compression chamber 190, below displacer piston 150 also varies in volume in respect of the movements of displacer piston 150 and power piston(s) (not shown). Compression chamber 190 is generally defined on one end by the bottom of displacer piston 150 and on the other end by the top of the power piston(s) (not shown).

The operation of FPSE 100 shown in FIG. 1 generally proceeds as follows. A heat source is applied as shown to the cylinder head of FPSE 100. The resulting thermal energy is transferred through the pressure vessel wall at cylinder head 140 and is imparted to the working fluid via heat exchanger 130 as discussed in greater detail below. Movement of the working fluid through the heat exchangers and the compression and expansion volumes within the machine to accomplish the Stirling cycle is predominantly driven by the motion of the displacer piston 150. At one point during the Stirling cycle, as the displacer piston 150 moves upward, the working fluid in expansion chamber 180 is displaced in the "backward" direction from expansion chamber 180, through the heat exchanger 130, through regenerator 110, through heat exchanger 120 and into compression chamber 190. In the ideal Stirling cycle, the power piston (not shown) is moved to compress the working fluid when the maximum quantity of the working fluid resides in the compression space 190 following the upward motion of displacer piston 150. Those practiced in the art will recognize that in practical embodiments of the Stirling cycle, the motions of the displacer piston 150 and power piston(s) are neither discontinuous nor completely out of phase with one another.

As displacer piston 150 moves downward, the working fluid in compression chamber 190 is forced in the "forward" direction through heat exchanger 120, through regenerator 110, through heat exchanger 130 and into expansion chamber 180. During the movement of the working fluid in the forward direction, the working fluid is heated, and as a result of working fluid expansion, mechanical work may be extracted from the cycle as the power piston is pushed by the working fluid in the direction of expansion.

The particular embodiment shown in FIG. 1 employs a BFIHX as heat exchanger 120 and a BFIHX as heat exchanger 130. For purposes of the following discussion, heat exchanger 120 is referred to herein as "cooler" and heat exchanger 130 is referred to herein as "heater" in keeping with their respective functions in this embodiment. The operation of each heat exchanger and each heat exchanger in connection with the operation of FPSE 100 overall is now discussed in detail.

Figure 2:
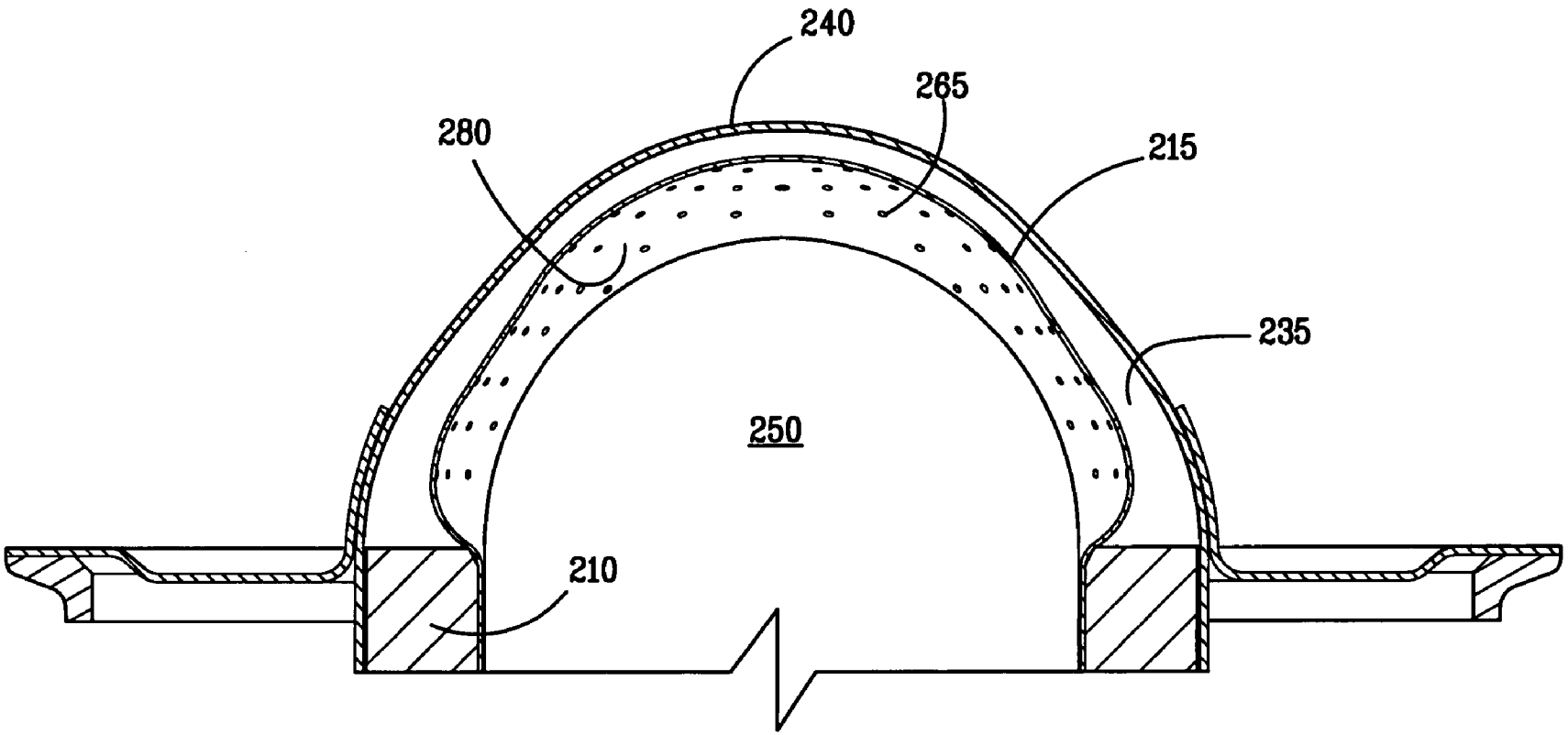
FIG. 2 is a detailed sectional view of the BFIHX heater embodiment of a heat exchanger of the present invention.

The BFIHX heater 130 in FIG. 1 is shown in greater detail in FIG. 2. Referring specifically to FIG. 2, BFIHX impingement baffle 215 is fastened to regenerator 210 and is supported thereby. Copper plating (not shown) is optionally placed along the inner surface of the pressure vessel wall 240 as required or desired to assist in moderating "hot spots" along the inner surface of cylinder head 240.

According to a preferred embodiment of the present invention, impingement baffle 215 is formed with a plurality of apertures 265 to provide jet impingement heat transfer either against the inner surface of the pressure vessel wall 240 or against the surface of the displacer 250. As discussed in greater detail below, the direction of fluid flow, whether "forward" or "backward", determines the surface upon which the working fluid impinges.

In a preferred embodiment of the present invention, BFIHX impingement baffle 215 is formed with a specific number of apertures 265 and a particular aperture spacing and pattern so as to maximize heat transfer through jet impingement. There exist many papers and other sources of information concerning jet impingement techniques such as, for example, "Enhanced Jet Impingement Heat Transfer with Crossflow at Low Reynolds Numbers" by G. Failla, et al. (published in the Journal of Electronics Manufacturing, Vol. 9, No. 2, June 1999) and "Heat Transfer by a Square Array of Round Air Jets Impinging Perpendicular to a Flat Surface Including the Effect of Spent Air" by D. M. Kercher and W. Tabakoff, (published in the Journal of Engineering Power, January 1970) which describe techniques for maximizing jet impingement function. For purposes of the present invention, aperture diameters ranging from 1 to 3 mm and spaced in a relatively uniform fashion over the surface of the impingement baffle with center-to-center spacing ranging from 6 to 10 mm may employed. The impingement baffle 215 may be fabricated from stainless steel, and may be formed using various techniques such as spinning, drawing, deep drawing, hydro-forming or machined from solid stock.

According to the construction of the novel heat exchanger design of the present invention, the amount of heat transfer to and from the working fluid varies depending upon the direction of the working fluid (i.e. "forward" toward expansion chamber 280 or "backward" away from expansion chamber 280). With the BFIHX heater configuration, the bulk of the external heat transferred to the working fluid during the cycle occurs when the flow is in the backward direction. When flowing in the backward direction from the expansion space 280 and through the impingement baffle 215, the working fluid impinges upon the pressure vessel wall 240. The high heat transfer rates achievable by impingement combined with the relatively high temperature difference between the expanded working fluid moving from the expansion space 280 and the pressure vessel wall 240 result in the post-impinged working fluid reaching a temperature near that of the pressure vessel wall temperature. The working fluid then proceeds into regenerator 210 where it gives up much of its energy before entering BFIHX cooler 120. In a well designed machine, this heat is returned to the working fluid by regenerator 210 when the fluid returns to the expansion space 280.

When flowing in the forward direction from regenerator 210, through manifold 235, through impingement baffle 215, the working fluid either impinges upon displacer 250, or the jets dissipate the fluid within the expansion space 280. In either case, less heat is transferred to the working fluid during this portion of the cycle because channel heat transfer between the working fluid in manifold 235 and the pressure vessel wall 240 is low and the subsequent impingement heat transfer either occurs between the working fluid and the displacer 250, at low temperature differential, or not at all.

Figure 3:
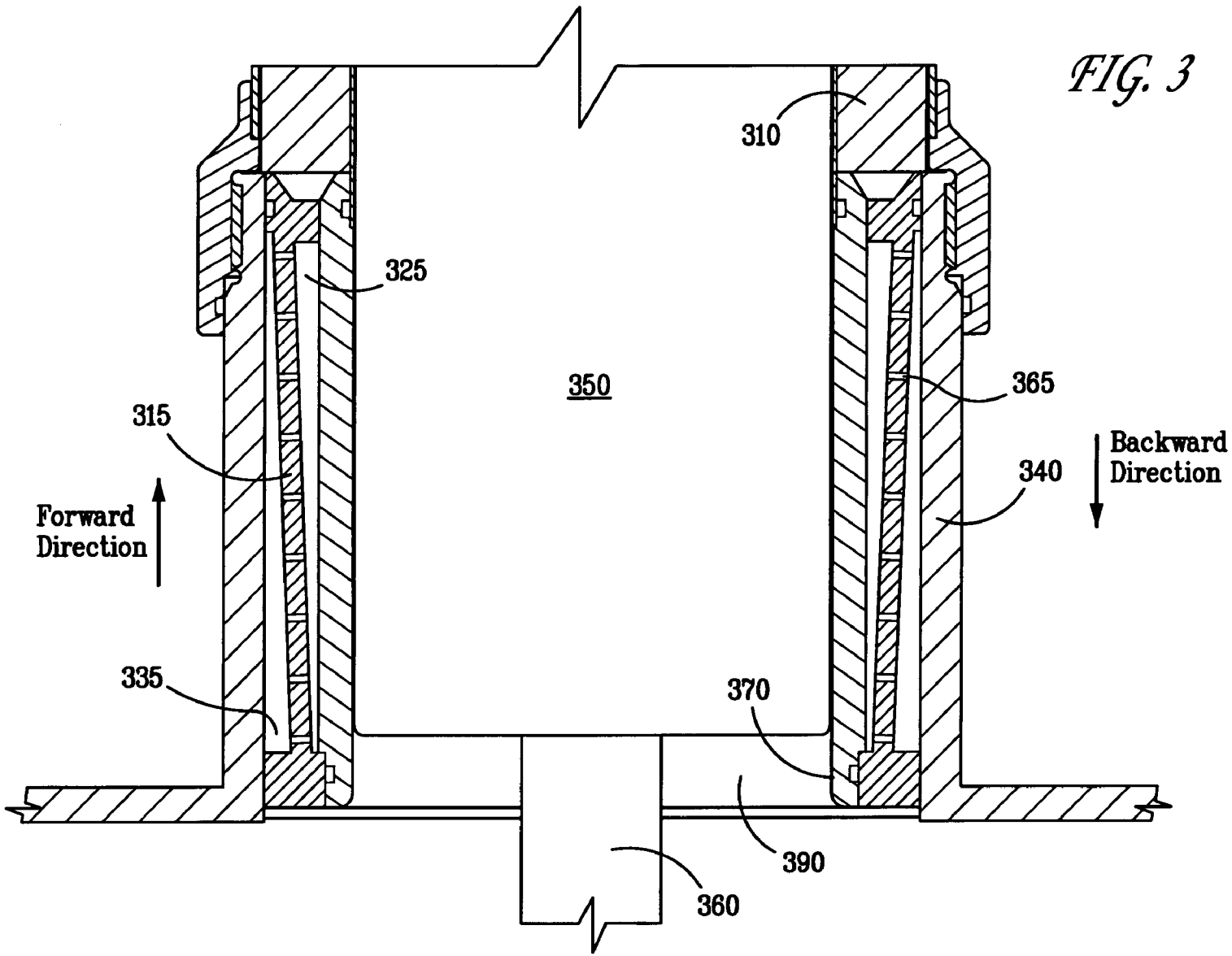
FIG. 3 is a detailed sectional view of the BFIHX cooler embodiment of a heat exchanger of the present invention.

The BFIHX cooler 120 comprises various functional components. Referring specifically to FIG. 3, BFIHX impingement baffle 315 is oriented between cylinder 370 and pressure vessel wall 340 so as to divide BFIHX cooler 120 volume into inner manifold 325 and outer manifold 335. The inner manifold 325 is open to regenerator 310 and in communication with the outer manifold 335, which is open to compression space 390, via the impingement ports 365.

With the BFIHX cooler configuration, the bulk of the heat extracted from the working fluid during the cycle occurs when the flow is in the backward direction. When flowing in the backward direction from regenerator 310, through inner manifold 325 and through impingement baffle 315, the working fluid impinges upon the pressure vessel wall 340. The high heat transfer rates achievable by impingement combined with the relatively high temperature difference between the working fluid moving from regenerator 310 and the pressure vessel wall 340 result in the post-impinged working fluid within outer manifold 335 reaching a temperature near that of the pressure vessel wall temperature. The working fluid then proceeds into the compression space 390.

As is explained below, the exit temperature from regenerator in the backward flow direction is significantly higher than the pressure vessel wall temperature. Post compression working fluid flowing in the forward direction from compression space 390, through outer manifold 335 and through impingement baffle 315 impinges upon the wall of inner manifold 325, which is at a higher temperature than the pressure vessel wall 340. Less heat is extracted from the working fluid during this portion of the cycle because channel heat transfer between the working fluid in outer manifold 335 and the pressure vessel wall 340 is low and the subsequent impingement heat transfer occurs between the working fluid and the wall of inner manifold 325 at low temperature differential. Subsequently, regenerator 310 is charged with a higher temperature fluid at its cold end than if a conventional heat exchanger were employed. In a preferred embodiment of the BFIHX cooler of the present invention, the gas is delivered to the cold end of regenerator 310 from the compression space 390 at the post compression temperature rather than the pressure vessel wall 340 temperature as it would in the preferred embodiments of conventional heat exchangers.

Figure 4:
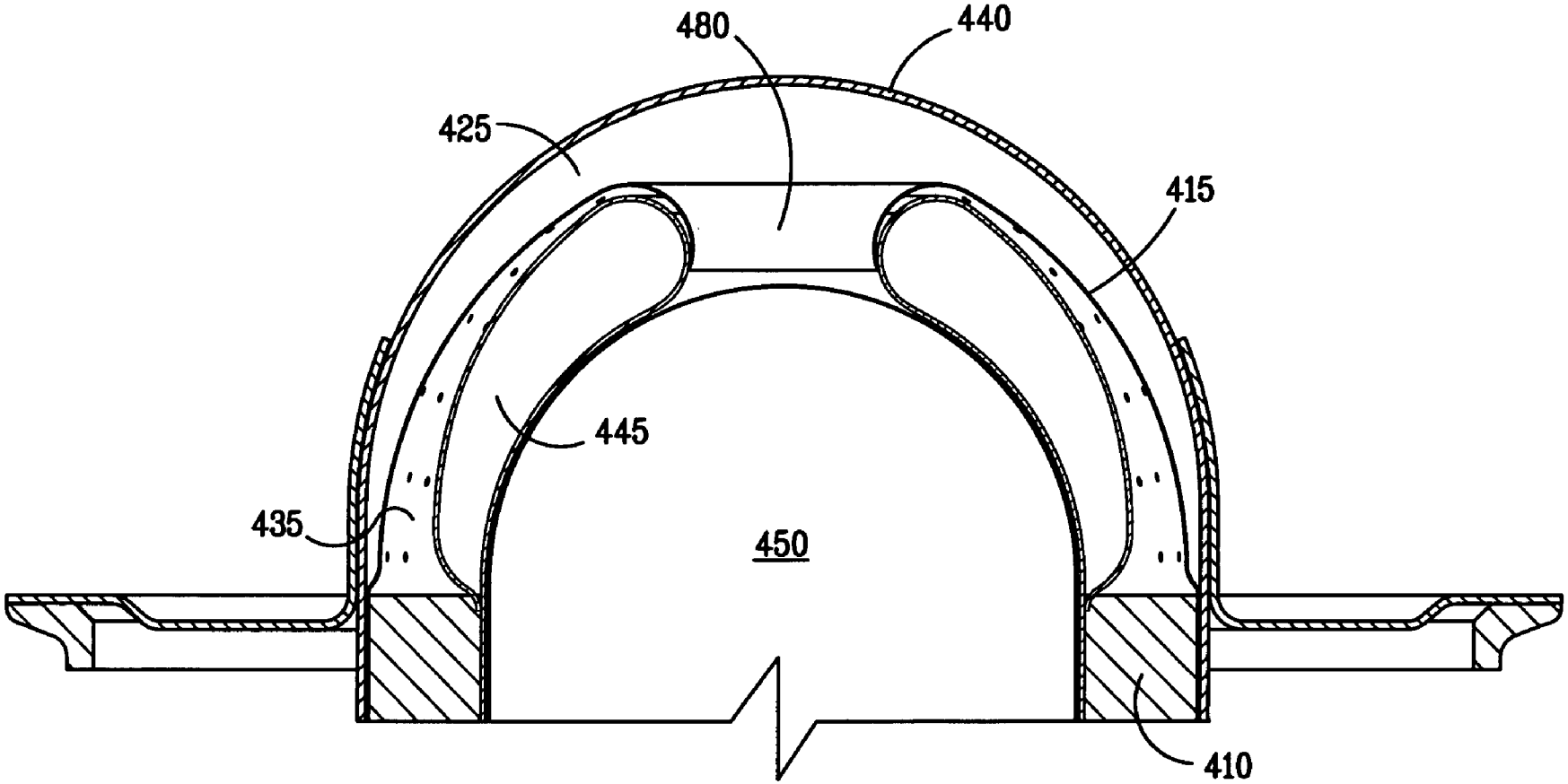
FIG. 4 is a detailed sectional view of the FFIHX heater embodiment of a heat exchanger of the present invention.

Turning now to FIG. 4, the FFIHX embodiment of the beat exchanger is next discussed. In this embodiment, as in the BFIHX cooler configuration, two manifolds are used to control heat transfer in both the forward and the backward direction. With the FFIHX heater configuration, the bulk of the external heat transferred to the working fluid during the cycle Occurs when the flow is in the forward direction. When flowing in the forward direction from regenerator 410, through inner manifold 435 and through impingement baffle 415, the working fluid impinges upon the pressure vessel wall 440. The high heat transfer rates achievable by impingement combined with the relatively high temperature difference between the compressed working fluid moving from regenerator 410 and the pressure vessel wall 440 result in the post impinged working fluid reaching a temperature near that of the pressure vessel wall temperature. The fluid then travels from outer manifold 425 into the expansion space 480. The FFIHX heater embodiment depicted in FIG. 4 also preferably includes a cavity 445 used to isolate volume from interacting in the cycle pressure variations.

As is explained below, the exit temperature from regenerator 410 in the forward flow direction is significantly below the pressure vessel wall temperature. Post-expansion working fluid flowing in the backward direction from the expansion space 480, through outer manifold 425, through impingement baffle 415, through inner manifold 435, and entering regenerator 410, acquires less heat from the source, pressure vessel wall 440. In the backward flow direction, channel heat transfer within the manifolds is low and impingement heat transfer occurs between the post expanded working fluid and inner manifold wall 435, at low temperature differential. Subsequently, regenerator 410 is charged with a lower temperature fluid at its hot end than if a conventional heat exchanger, or the BFIHX of the present invention, were employed. Thus, in a preferred embodiment of the FFIHX heater, the working fluid is delivered to the hot end of regenerator 410 from expansion space 490 at the post expansion temperature, rather than the pressure vessel wall 440 temperature as it would in the preferred embodiments of conventional heat exchangers.

Use of the FFIHX embodiment as a heater provides a greater thermodynamic cycle advantage over use of the BFIHX as a heater. As such, with the FFIHX, the fluid is cooler by the time it reaches regenerator 410 allowing for the use of a smaller and less expensive regenerator. In addition, less of a pressure drop penalty is incurred through the use of the FFIHX than with the BFIHX embodiment.

It will be understood by one of skill in the art that while the BFIHX is generally less effective in terms of minimizing heat transfer to the working fluid in the backward flow direction when compared to the FFIHX embodiment, the BFIHX embodiment presents the advantages of requiring less metal for construction as well as a much simpler and more reliable fabrication and installation process.

The disclosed heat exchangers of the present invention provide significant advantages including, for example, significantly reduced cost in terms of construction, additional reliability in operation, and enhanced heat transfer characteristics per unit of size. The heat exchanger of the present invention in its various embodiments may be constructed from relatively inexpensive 300 series stainless steels.

Additionally, high cost and risky brazing operations involved in the construction and installation of the heat exchangers can be eliminated particularly through the use of the BFIHX embodiment of the present invention. Instead, low cost machining and forming techniques may be used and the FFIHX and BFIHX embodiments of the present invention may be easily inserted into the pressure vessel assembly.

A novel heat exchanger design in various embodiments and for use both in connection with the heater head and the cooling segment of a Stirling cycle machine has been disclosed herein. As will be understood by one of skill in the art, the invention is not necessarily limited to the particular embodiments disclosed herein and that various other embodiments are possible while still remaining within the scope and spirit of the present invention.

What is claimed is:

1. A Stirling cycle machine operating via the compression and expansion of a working fluid, said Stirling cycle machine comprising:

an expansion chamber defined in a first cylinder by a piston;

a compression chamber defined in a second cylinder by said piston;

said expansion chamber and said compression chamber in communication via at least one passageway;

said passageway comprising a heat exchanger, said heat exchanger including an impingement baffle arranged to direct said working fluid so as to provide a higher heat transfer function when said working fluid flows in a first direction, due to the impingement baffle causing impingement of the working fluid on a heat transfer surface during flow in the first direction, as opposed to a lower heat transfer function when said working fluid flows in a second direction, due to said working fluid flowing past the heat transfer surface and through the impingement baffle away from the heat transfer surface during flow in the second direction.

2. The Stirling cycle machine of claim 1 wherein said first cylinder and said second cylinder comprise a single cylinder.

3. The Stirling cycle machine of claim 1 wherein said heat exchanger comprises a forward flow heat exchanger adjacent to said expansion chamber.

4. The Stirling cycle machine of claim 1 wherein said heat exchanger comprises a backward flow heat exchanger adjacent to said expansion chamber.

5. The Stirling cycle machine of claim 1 wherein said heat exchanger comprises a backward flow heat exchanger adjacent to said compression chamber.

6. The Stirling cycle machine of claim 1 wherein said piston is a displacer piston.

7. The Stirling cycle machine of claim 1 wherein said heat exchanger comprises a plurality of apertures which cause jet impingement of said working fluid against a surface.

8. The Stirling cycle machine of claim 7 wherein said surface comprises a plating adjacent to an interior pressure vessel wall of said Stirling cycle machine when said working fluid is flowing toward said expansion chamber.

9. The Stirling cycle machine of claim 8 wherein said plating comprises a copper plating.

10. The Stirling cycle machine of claim 7 wherein said surface comprises an interior pressure vessel wall of said Stirling cycle machine when said working fluid is flowing toward said expansion chamber.

11. The Stirling cycle machine of claim 7 wherein said surface comprises an interior pressure vessel wall of said Stirling cycle machine, when said working fluid is flowing toward said compression chamber.

12. The Stirling cycle machine of claim 1 wherein said heat exchanger is located adjacent to said expansion chamber and said passageway further comprises a second heat exchanger located adjacent to said compression chamber.

13. The Stirling cycle machine of claim 12 wherein said heat exchanger is a forward flow heat exchanger and said second heat exchanger is a backward flow heat exchanger.

14. The Stirling cycle machine of claim 12 wherein said heat exchanger is a backward flow heat exchanger and said second heat exchanger is a backward flow heat exchanger.

15. The Stirling cycle machine of claim 12 wherein said heat exchanger and said second heat exchanger communicate with one another through a regenerator.

16. A heat exchanger for a Stirling cycle machine comprising:

an inlet for receiving working fluid;

an impingement baffle having a plurality of apertures thereon;

a manifold formed in the space between the interior wall of said Stirling cycle machine and said impingement baffle;

wherein said working fluid is caused by the impingement baffle to impinge upon said interior wall of said Stirling cycle machine when said working fluid is flowing in a first direction, thereby increasing heat transfer, and said working fluid is caused by the impingement baffle to be directed into said manifold when said working fluid is flowing in a second direction, thereby decreasing heat transfer.

17. The heat exchanger of claim 16 wherein said heat exchanger is located adjacent to said expansion chamber.

18. A method for transferring heat to and from working fluid within a Stirling cycle machine comprising the steps of:

providing an expansion chamber defined in a cylinder by a piston;

providing a compression chamber defined in said cylinder by said piston;

causing said working fluid to flow between said compression chamber and said expansion chamber via at least one passageway;

wherein said passageway comprises a heat exchanger, said heat exchanger including an impingement baffle arranged to direct said working fluid so as to provide a substantially higher heat transfer function when said working fluid flows in a first direction due to the impingement baffle causing impingement of the working fluid on a heat transfer surface during flow in the first direction, as opposed to a lower heat transfer function when said working fluid flows in a second direction, due to said working fluid flowing past the heat transfer surface and through the impingement baffle away from the heat transfer surface during flow in the second direction.

19. The method of claim 18 wherein said at heat exchanger comprises a plurality of apertures which cause jet impingement of said working fluid against a surface.

20. The method of claim 19 wherein said surface is a relatively hot surface when said working fluid is flowing towards said expansion chamber as opposed to said surface being a relatively cool surface when said working fluid is flowing toward said compression chamber.

21. The method of claim 19 wherein said surface comprises a plating adjacent to an interior wall of said Stirling cycle machine when said working fluid is flowing toward said expansion chamber.

22. The method of claim 21 wherein said plating comprises a copper plating.

23. The method of claim 19 wherein said surface comprises an interior pressure vessel wall of said Stirling cycle machine when said working fluid is flowing toward said expansion chamber.

24. The method of claim 19 wherein said surface comprises an interior pressure vessel wall of said Stirling cycle machine, when said working fluid is flowing toward said compression chamber.

25. The method of claim 18 wherein said at heat exchanger is located adjacent to said expansion chamber and said passageway further comprises a second heat exchanger located adjacent to said compression chamber.

26. A Stirling cycle machine operating via the compression and expansion of a working fluid, said Stirling cycle machine comprising:

an expansion chamber defined in a first cylinder by a piston;

a compression chamber defined in a second cylinder by said piston;

said expansion chamber and said compression chamber in communication via at least one passageway;

said passageway comprising an impingement heat exchanger which includes an impingement baffle arranged to direct said working fluid so as to provide a substantially higher heat transfer function when said working fluid flows in the direction toward said compression chamber, due to the impingement baffle causing impingement of the working fluid on a heat transfer surface during flow in the direction toward said compression chamber, as opposed to a lower heat transfer function when said working fluid flows toward said expansion chamber, due to said working fluid flowing past the heat transfer surface and through the impingement baffle away from the heat transfer surface during flow in the direction toward said expansion chamber.

* * * * *

UNITED STATES PATENT AND TRADEMARK OFFICE

CERTIFICATE OF CORRECTION

PATENT NO. : 7,114,334 B2
APPLICATION NO. : 10/883310
DATED : October 3, 2006
INVENTOR(S) : Robert O. Pellizzari It is certified that error appears in the above-identified patent and that said Letters Patent is hereby corrected as shown below:

TITLE PAGE item (75), INVENTORS: the name of the inventor should read --Robert O. Pellizzari--.
In column 8, line 19, "Occurs" should read --occurs--.
In column 10, line 53, after "direction" please insert -- , --.

Signed and Sealed this

Ninth Day of January, 2007

JON W. DUDAS
*Director of the United States Patent and Trademark Office*

UNITED STATES PATENT AND TRADEMARK OFFICE

CERTIFICATE OF CORRECTION

PATENT NO. : 7,114,334 B2
APPLICATION NO. : 10/883310
DATED : October 3, 2006
INVENTOR(S) : Robert O. Pellizzari It is certified that error appears in the above-identified patent and that said Letters Patent is hereby corrected as shown below:

Title Page, item (75), the name of the inventor should read --Robert O. Pellizzari--.
In column 8, line 19, "Occurs" should read --occurs--.
In column 10, line 53, after "direction" please insert -- , --.

Signed and Sealed this

Thirtieth Day of January, 2007

JON W. DUDAS
*Director of the United States Patent and Trademark Office*